US012209358B2

(12) United States Patent
Keh et al.

(10) Patent No.: US 12,209,358 B2
(45) Date of Patent: Jan. 28, 2025

(54) METHOD FOR PREPARING WATER REPELLENT TEXTILE SUBSTRATES AND PRODUCTS THEREOF

(71) Applicant: The Hong Kong Research Institute of Textiles and Apparel Limited, Hong Kong (CN)

(72) Inventors: Edwin Yee Man Keh, Hong Kong (CN); Lei Yao, Hong Kong (CN); Alex Chan, Hong Kong (CN); Un Teng Lam, Hong Kong (CN); Hanrong Zhang, Hong Kong (CN); Ho Man Chan, Hong Kong (CN)

(73) Assignee: The Hong Kong Research Institute of Textiles and Apparel Limited, Hong Kong (CN)

( * ) Notice: Subject to any disclaimer, the term of this patent is extended or adjusted under 35 U.S.C. 154(b) by 873 days.

(21) Appl. No.: 16/792,946

(22) Filed: Feb. 18, 2020

(65) Prior Publication Data

US 2021/0254276 A1 Aug. 19, 2021

(51) Int. Cl.
*D06M 15/05* (2006.01)
*D06M 23/00* (2006.01)

(52) U.S. Cl.
CPC ..... *D06M 15/05* (2013.01); *D06M 23/00* (2013.01); *D06M 2200/10* (2013.01)

(58) Field of Classification Search
CPC ... D01M 15/05; D06M 23/00; D06M 2200/10
USPC ..... 442/118
See application file for complete search history.

(56) References Cited

U.S. PATENT DOCUMENTS

| | | | | |
|---|---|---|---|---|
| 2,750,306 | A | 6/1956 | Pingree et al. | |
| 3,598,633 | A | 8/1971 | Rudman | |
| 9,506,187 | B2 * | 11/2016 | Minko | D06P 1/0016 |
| 2003/0212232 | A1 | 11/2003 | Majeti | |
| 2015/0368441 | A1 | 12/2015 | Retsina et al. | |
| 2020/0216681 | A1 * | 7/2020 | Qin | D06N 3/02 |

FOREIGN PATENT DOCUMENTS

| | | | |
|---|---|---|---|
| CN | 101785588 | A | 7/2010 |
| CN | 104371526 | A | 2/2015 |
| CN | 104594028 | A | 5/2015 |
| CN | 105384960 | A | 3/2016 |
| CN | 105441507 | A | 3/2016 |
| CN | 105566502 | A | 5/2016 |
| CN | 107199020 | A | 9/2017 |
| CN | 107254809 | A | 10/2017 |
| CN | 107858842 | A | 3/2018 |
| CN | 108251903 | A | 7/2018 |

(Continued)

OTHER PUBLICATIONS

International Search Report and Written Opinion of PCT application No. PCT/CN2020/075646 issued from the International Search Authority on Nov. 19, 2020.

(Continued)

*Primary Examiner* — Vincent Tatesure
(74) *Attorney, Agent, or Firm* — Spruson & Ferguson (Hong Kong) Limited

(57) ABSTRACT

The present disclosure relates to methods for producing water repellent textile substrates and products thereof. The methods can be conducted without the use of perfluorocarbons.

12 Claims, 4 Drawing Sheets

(56) References Cited

FOREIGN PATENT DOCUMENTS

| | | | |
|---|---|---|---|
| CN | 108456966 | A | 8/2018 |
| CN | 108560314 | A | 9/2018 |
| CN | 108610474 | A | 10/2018 |
| CN | 110777567 | A | 2/2020 |
| DE | 2101816 | A | 8/1972 |
| DE | 102009014957 | A1 | 10/2010 |
| FR | 2715411 | A1 | 7/1995 |
| GB | 881760 | A | 11/1961 |
| HU | 0100979 | A2 | 12/2002 |
| JP | 48042837 | B | 12/1973 |
| JP | 49006800 | B | 2/1974 |
| JP | 60151383 | A | 8/1985 |
| JP | 2002-60670 | A | 2/2002 |
| WO | 2001066851 | A1 | 9/2001 |
| WO | 2012152997 | A1 | 11/2012 |
| WO | 2014011112 | A1 | 1/2014 |
| WO | 2014049208 | A1 | 4/2014 |
| WO | 2016034687 | A1 | 3/2016 |

OTHER PUBLICATIONS

Extended European Search Report of EP application No. 20157890.3 issued from the European Patent Office on Sep. 17, 2020.

Yu et al.; Hydrophobic modification of cotton fabric with octadecylamine via laccase/TEMPO mediated grafting; Carbohydrate Polymers; vol. 137; Feb. 10, 2016, abstract, pp. 550, 555, sections 2.1-2.5, 4; Elsevier.

Xiong et al.; Wearable All-Fabric-Based Triboelectric Generator for Water Energy Harvesting; Advanced Energy Materials; vol. 7, No. 21; Jul. 21, 2017; p. 1701243; Wiley.

Wang et al.; Superhydrophobic surfaces from surface-hydrophobized cellulose fibres with stearoyl groups; Cellulose; vol. 22, No. 1; Nov. 18, 2014; pp. 289-299; Springer.

Liu et al.; Hydrophobic modification of regenerated cellulose microparticles with enhanced emulsifying capacity for O/W Pickering emulsion; Cellulose; vol. 26, No. 10; May 29, 2019; pp. 6215-6228; Springer.

* cited by examiner

METHOD FOR PREPARING WATER REPELLENT TEXTILE SUBSTRATES AND PRODUCTS THEREOF

TECHNICAL FIELD

The present disclosure relates to a method of preparing a water repellent textile substrates and products thereof. The method can use post-consumer textile waste or virgin cellulose material as starting materials and does not call for the use of perfluorocarbons.

BACKGROUND

The majority of existing water repellent finishes rely on the water repellent properties of perfluorocarbons (PFC), such as perfluorooctane sulfonate (PFOS) and perfluorooctanoic acid (PFOA), which possess extremely low surface energy due to their long chain perfluoroalkyl groups. However, the use of PFC has gradually been banned in many countries due to its associated health and environmental concerns. The concerns of using PFCs in textile applications is even more prominent compared to their use in other applications, as PFCs in textiles will gradually leak into the environment during the laundering process.

To avoid the use of PFCs, some PFC-free water repellent textile surface finishes have been developed, which are typically based on the use of polymeric materials such as silicone.

A number of methods for hydrophobic modification of cellulose have been developed, although the majority of these methods are not for textile applications. CN 105566502, CN 107254809, CN 104594028, CN 108456966, and CN 108251903 describe modification of cellulose with silica-containing materials, such as silane, silicone and silica oxide. U.S. Pat. No. 2,750,306 teaches direct cellulose modification using chloromethyl acyl amide based quaternary ammonium compounds. US 20150368441 teaches lignin deposition on cellulose to provide hydrophobic properties for use in the papermaking industry. The foregoing methods are applied to various substrates, but are not applied to cellulose powder. CN 107199020 and WO 2014011112 teach octadecylamine modification of cellulose particles, but both use a physical approach and as such do not use chemical reactions. None of the aforementioned methods provide an aqueous-based method for imparting water repellency to textiles that is suitable for fabric applications, e.g., by dipping or by pad dry cure process.

There is thus a need for improved PFC-free water-based methods for imparting water repellency to textile substrates.

SUMMARY

It is the objective of the present disclosure to provide a method of preparing a PFC-free water repellent surface finish for fabric applications using, but not limited to, recycled cellulose powder. When used, the recycled cellulose powders can be obtained from recycled blended textile via the hydrothermal treatment, such as the process described in PCT Patent Application No. PCT/CN2019/107499. The first step comprises performing surface modification of the obtained recycled cellulose powder thereby transforming the hydrophilic surface to a hydrophobic surface by chemical reaction. Surface modification can be performed by esterification of cellulose or laccase/TEMPO-mediated grafting on cellulose. The second step comprises adding binders and water in order to prepare a water-based formulation suitable for fabric and/or textile substrate application. The final surface finish solution can be applied to fabrics or textile substrates by dip coating or by pad-dry-cure process.

In a first aspect, provided herein is a method of preparing a water repellant textile substrate, the method comprising: contacting a textile substrate with a surface finishing solution comprising a binder and a hydrophobic cellulose powder thereby forming a surface finishing solution treated textile substrate, wherein the hydrophobic cellulose powder comprises a repeating unit of Formula 1:

1

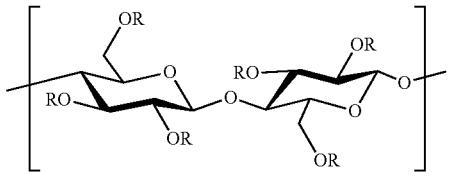

wherein each R is independently selected from the group consisting of hydrogen and —$CO_2R^1$; and $R^1$ is $C_{10}$-$C_{40}$ alkyl, with the proviso that at least one R is —$CO_2R^1$; or a repeating unit of Formula 2:

2

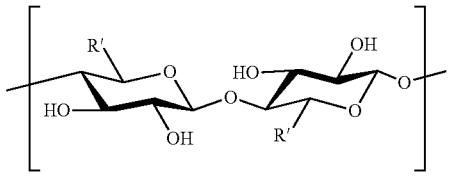

wherein each R' is independently selected from the group consisting of —$CH_2OH$ and —C(H)═$NR^2$;

and $R^2$ is $C_{10}$-$C_{40}$ alkyl, with the proviso that at least one R' is —C(H)═$NR^2$; and optionally curing the surface finishing solution treated textile substrate thereby forming the water repellant textile substrate.

In a first embodiment of the first aspect, provided herein is the method of the first aspect, wherein the textile substrate is cotton, polyester, or a combination thereof.

In a second embodiment of the first aspect, provided herein is the method of the first aspect, wherein the surface finishing solution comprises water, the binder, and the hydrophobic cellulose powder.

In a third embodiment of the first aspect, provided herein is the method of the first aspect, further comprising: contacting a cellulose powder and an alkyloyl halide thereby forming the hydrophobic cellulose powder comprising the repeating unit of Formula 1; or contacting a cellulose powder with an oxidizing agent in an aqueous dispersion thereby forming a partially oxidized cellulose powder comprising a plurality of aldehyde moieties and contacting the partially oxidized cellulose powder with a primary alkyl amine in an aqueous dispersion thereby forming the hydrophobic cellulose powder comprising the repeating unit of Formula 2.

In a fourth embodiment of the first aspect, provided herein is the method of the third embodiment of the first aspect, wherein the cellulose powder has a particle size below 100 μm.

In a fifth embodiment of the first aspect, provided herein is the method of the third embodiment of the first aspect, wherein in the step of contacting the cellulose powder with the alkyloyl halide, the cellulose powder is present at a concertation of 10 to 100 mg/mL.

In a sixth embodiment of the first aspect, provided herein is the method of the fifth embodiment of the first aspect, wherein the alkyloyl halide is $CH_3(CH_2)_nCH_2COCl$, wherein n is a whole number selected from 10 to 40 and the alkyloyl halide is present at a concentration of 50 to 500 mg/mL.

In a seventh embodiment of the first aspect, provided herein is the method of the sixth embodiment of the first aspect, wherein the step of contacting the cellulose powder with the alkyloyl halide is conducted at 60 to 120° C.

In an eighth embodiment of the first aspect, provided herein is the method of the third embodiment of the first aspect, wherein the oxidizing agent comprises laccase and (2,2,6,6-tetramethylpiperidin-1-yl)oxyl (TEMPO).

In a ninth embodiment of the first aspect, provided herein is the method of the eighth embodiment of the first aspect, wherein in the step of contacting the cellulose powder with laccase and TEMPO, the cellulose powder is present at a concentration of 1 to 50 mg/mL in the aqueous dispersion; and the laccase and TEMPO are each independently present at a concentration of 0.5 mg/mL to 30 mg/mL in the aqueous dispersion.

In a tenth embodiment of the first aspect, provided herein is the method of the third embodiment of the first aspect, wherein the primary alkyl amine is of $NH_2CH_2(CH_2)_nCH_3$, wherein n is whole number selected from 10 to 40; and in the step of contacting the partially oxidized cellulose powder with a primary alkyl amine, the primary alkyl amine is present at a concentration of 10 to 100 mg/mL in the aqueous dispersion.

In an eleventh embodiment of the first aspect, provided herein is the method of the ninth embodiment of the first aspect, wherein the step of contacting the cellulose powder with the laccase and TEMPO is conducted at 25 to 60° C.

In an twelfth embodiment of the first aspect, provided herein is the method of the ninth embodiment of the first aspect, where the binder comprises a polymer comprising acrylic, ethylene, butadiene, or a combination thereof; or the binder comprises a polyurethane.

In a thirteenth embodiment of the first aspect, provided herein is the method of the first aspect, wherein the hydrophobic cellulose powder is present at a concentration of 1 to 10 g/L in the surface finishing solution.

In a fourteenth embodiment of the first aspect, provided herein is the method of the first aspect, wherein binder is present at a concentration of 50-250 g/L in the surface finishing solution and the binder solid content is 20 to 50 wt %.

In a fifteenth embodiment of the first aspect, provided herein is the method of the first aspect, wherein the surface finishing solution treated textile substrate is cured at a temperature of 120 to 160° C.

In a sixteenth embodiment of the first aspect, provided herein is the method of the third embodiment of the first aspect, wherein the method comprises: contacting cellulose powder with an alkyloyl halide having the formula $CH_3(CH_2)_nCH_2COCl$, wherein n is a whole number selected from 10 to 40, at a temperature of 60 to 120° C. thereby forming hydrophobic cellulose powder comprising the repeating unit of Formula 1, wherein the cellulose powder is present at a concertation of 10 to 100 mg/mL; and the alkyloyl halide is present at a concentration of 50 to 500 mg/mL; and contacting a textile substrate with a surface finishing solution comprising the hydrophobic cellulose powder and a binder, wherein the binder comprises a polymer comprising acrylic, ethylene, butadiene, or a combination thereof; or the binder comprises a polyurethane; the binder is present at a concentration of 50-250 g/L in the surface finishing solution; and the binder solid content is 20 to 50 wt % thereby forming a surface finishing solution treated textile substrate; and curing the surface finishing solution treated textile substrate at a temperature of 120 to 160° C. thereby forming the water repellant textile substrate.

In a seventeenth embodiment of the first aspect, provided herein is the method of the third embodiment of the first aspect, wherein the method comprises: contacting cellulose powder with laccase and TEMPO in an aqueous dispersion at 25 to 60° C., wherein the cellulose powder is present at a concentration of 1 to 50 mg/mL in the aqueous dispersion; and the laccase and TEMPO are each independently present at a concentration of 0.5 mg/mL to 30 mg/mL in the aqueous dispersion; thereby forming a partially oxidized cellulose powder comprising a plurality of aldehyde moieties; contacting the partially oxidized cellulose powder with a primary alkyl amine having the formula $CH_3(CH_2)_nCH_2NH_2$, wherein n is a whole number selected from 10 to 40, in an aqueous dispersion at temperature of 60 to 120° C., wherein the primary alkyl amine is present at a concentration of 10 to 100 mg/mL in the aqueous dispersion; thereby forming a hydrophobic cellulose powder comprising the repeating unit of Formula 2; contacting a textile substrate with a surface finishing solution comprising the hydrophobic cellulose powder and a binder, wherein the binder comprises a polymer comprising acrylic, ethylene, butadiene, or a combination thereof; or the binder comprises a polyurethane; the binder is present at a concentration of 50-250 g/L in the surface finishing solution; and the binder solid content is 20 to 50 wt % thereby forming a surface finishing solution treated textile substrate; and curing the surface finishing solution treated textile substrate at a temperature of 120 to 160° C. thereby forming the water repellant textile substrate.

In a second aspect, provided herein is a water repellant textile substrate prepared according to the method of the first aspect.

In a third aspect, provided herein is a surface finished water repellant textile substrate prepared according to the method of claim sixteenth embodiment of the first aspect.

In a fourth aspect, provided herein is a surface finished water repellant textile substrate prepared according to the method of seventh embodiment of the first aspect.

DETAILED DESCRIPTION

Figure 1:
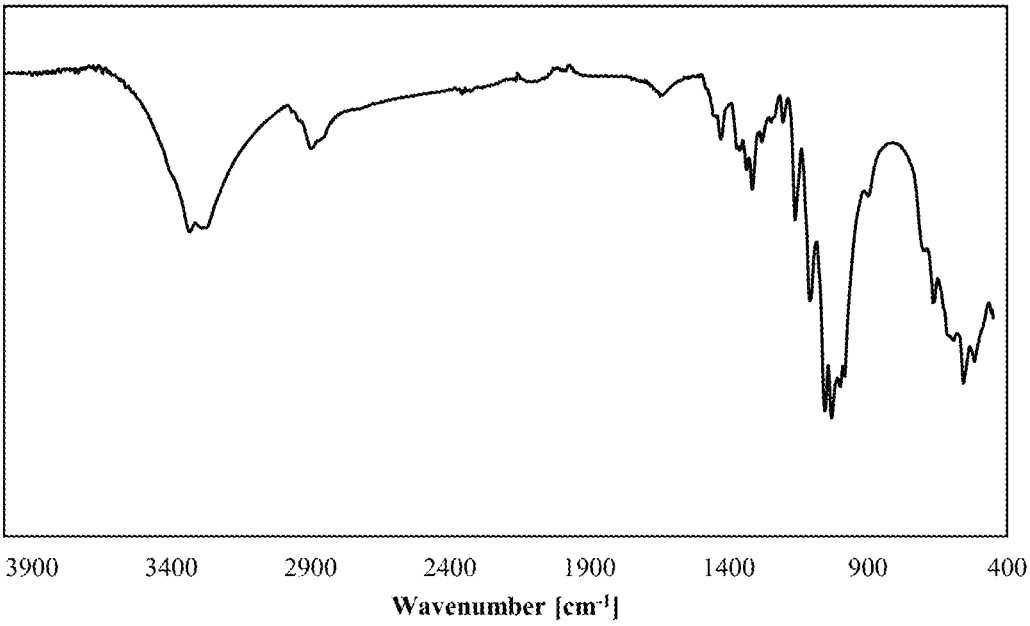
FIG. 1 depicts a Fourier-transform infrared spectroscopy (FTIR) spectrum of cellulose powder after hydrothermal treatment.
Figure 2A:
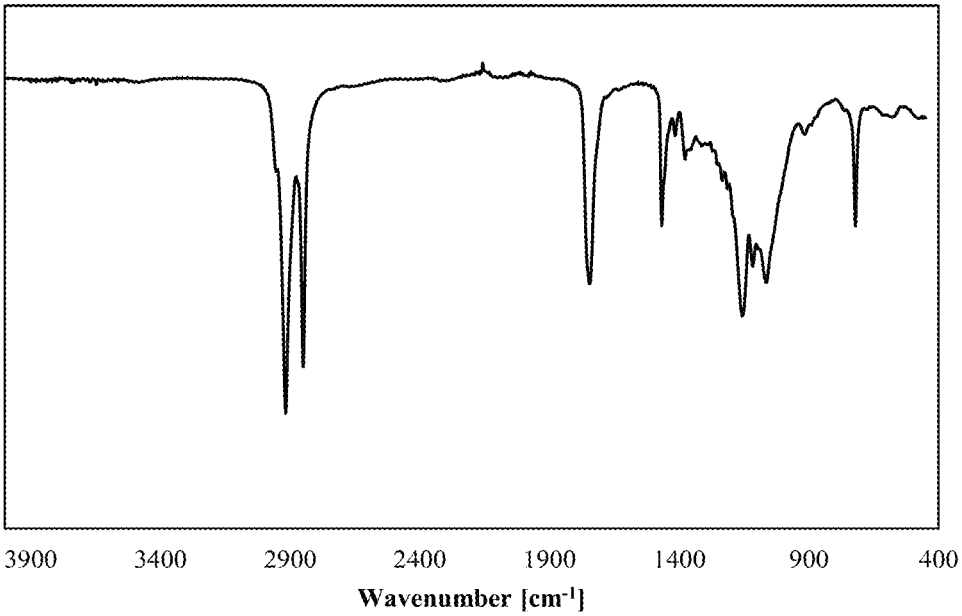
FIG. 2A depicts a FTIR spectrum of modified cellulose powder by esterification. Additional peaks at 1468 $cm^{-1}$, 2852 $cm^{-1}$, and 2918 $cm^{-1}$ for C—H bonds are observed.
Figure 2B:
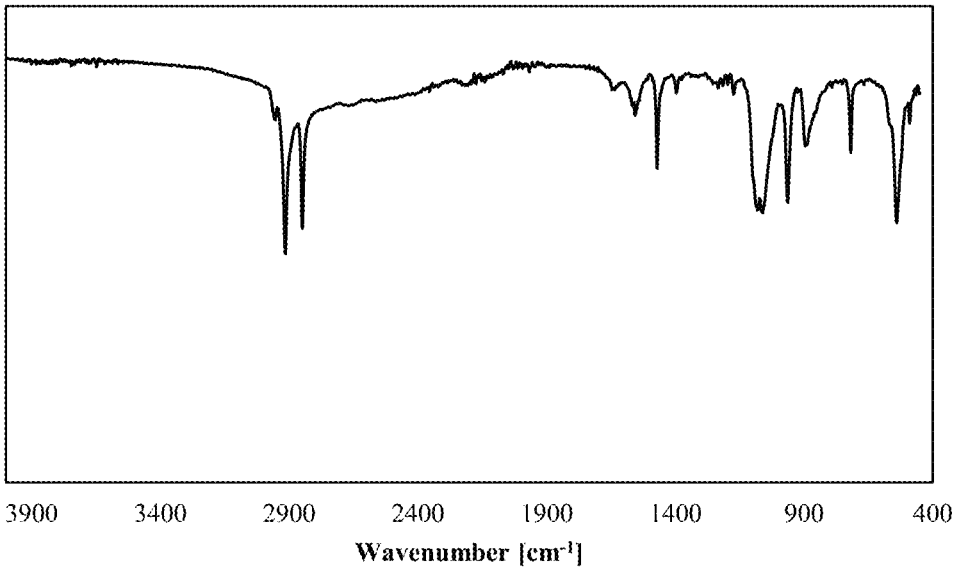
FIG. 2B depicts a FTIR spectrum of modified cellulose powder by laccase/TEMPO mediated grafting. Additional peaks at 1.471 $cm^{-1}$, 2847 $cm^{-1}$, and 2917 $cm^{-1}$ for C—H bonds are observed.
Figure 3:
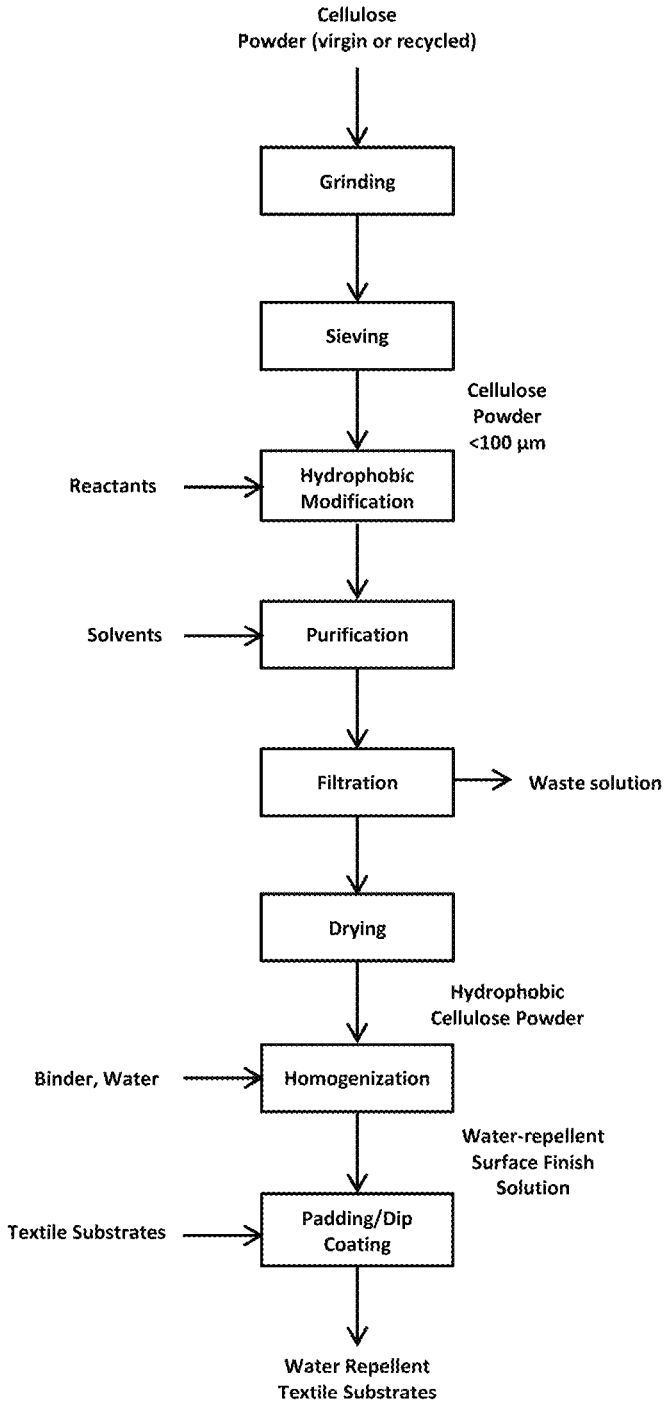
FIG. 3 depicts a flow diagram for the preparation of cellulose based water repellent surface finish according to certain embodiments of the methods described herein.
Figure 4:
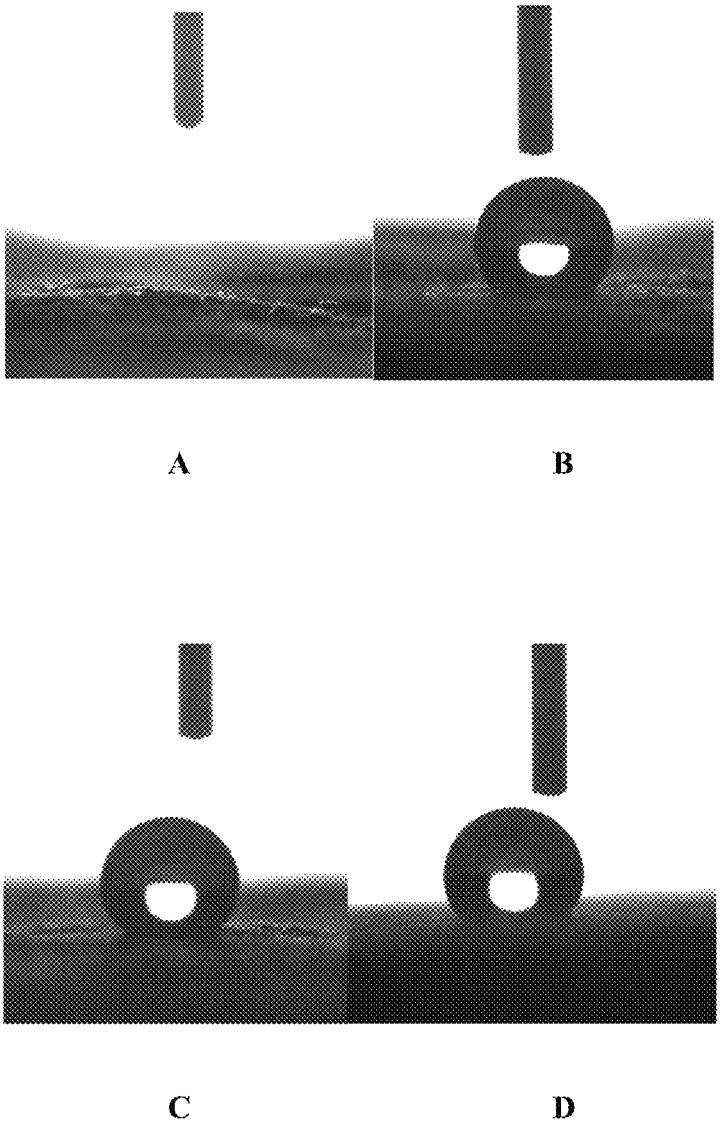
FIG. 4 depicts the contact angle measurement of cotton fabric (a) Before surface finish application (b) after application of surface finish in Example 3 (c) after application of surface prepared in Example 4 (d) after application of surface prepared in Example 4.

Provided herein is a method of applying a water repellant surface finish comprising a binder and hydrophobic cellulose powder to a textile substrate. In certain embodiments, the method does not call for the use of perfluorocarbons, e.g., either as a solvent, reagent, or furnished in the finished water repellant textile product.

In certain embodiments, the method of applying a water repellant surface finish comprises: contacting a cellulose powder and an alkyloyl halide; or contacting a cellulose powder with an oxidizing agent in an aqueous dispersion thereby forming a partially oxidized cellulose powder comprising a plurality of aldehyde moieties and contacting the partially oxidized cellulose powder with a primary alkyl amine in an aqueous dispersion; thereby forming a hydrophobic cellulose powder; contacting a textile substrate with a surface finishing solution comprising a binder and the hydrophobic cellulose powder thereby forming a surface finishing solution treated textile; and optionally curing the surface finishing solution treated textile thereby forming a water repellant water repellant textile substrate.

In certain embodiments, the method of applying a water repellant surface finish comprises: contacting a textile substrate with a surface finishing solution comprising a binder and a hydrophobic cellulose powder thereby forming a surface finishing solution treated textile substrate, wherein the hydrophobic cellulose powder comprises a repeating unit of Formula 1:

1

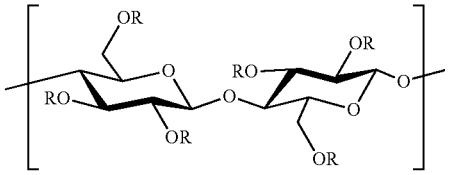

wherein each R is independently selected from the group consisting of hydrogen and $CO_2R^1$; and $R^1$ is $C_{10}$-$C_{40}$ alkyl, with the proviso that at least one R is —$CO_2R^1$; or a repeating unit of Formula 2:

2

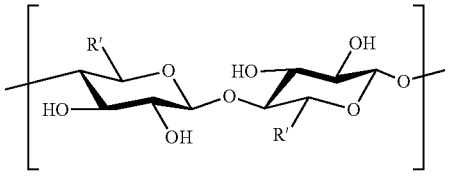

wherein each R' is independently selected from the group consisting of —$CF_2OH$ and —C(H)═$NR^2$; and $R^2$ is $C_{10}$-$C_{40}$ alkyl; and optionally curing the surface finishing solution treated textile substrate thereby forming a water repellant textile substrate.

In certain embodiments, the method comprises contacting a textile substrate with a surface finishing solution comprising a binder and a hydrophobic cellulose powder comprising a repeating unit of Formula 1:

1

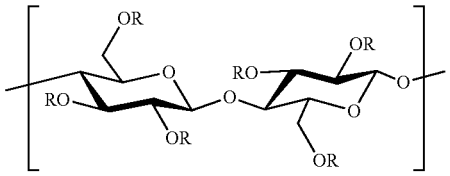

wherein each instance of R is independently selected from the group consisting of hydrogen and —$CO_2R^1$, with the proviso that at least one R is —$CO_2R^1$, wherein $R^1$ is $C_{10}$-$C_{40}$ alkyl. $R^1$ can be $C_{10}$-$C_{40}$ branched alkyl, $C_{10}$-$C_{40}$ linear alkyl, or $C_{10}$-$C_{40}$ cycloalkyl. In certain embodiments, $R^1$ is —$(CH_2)_nCH_3$, wherein n is 10 to 40, 10 to 30, 10 to 20, 15 to 20, or 17 to 20. In certain embodiments, $R^1$ is —$(CH_2)_{17}CH_3$. In certain embodiments, 1, 2, 3, 4, 5, or 6 instances of R in the repeating unit of Formula 1 is —$CO_2R^1$. The number of instances of R in the repeating unit of Formula 1 that is —$CO_2R^1$ can be controlled by appropriate selection of reagent stoichiometry and reaction conditions and is well within the skill of a person of ordinary skill in the art. In certain embodiments, the hydrophobic cellulose powder is prepared according to any of the methods described herein.

In certain embodiments, the method comprises contacting a textile substrate with a surface finishing solution comprising a binder and hydrophobic cellulose powder comprising a repeating unit of Formula 2:

2

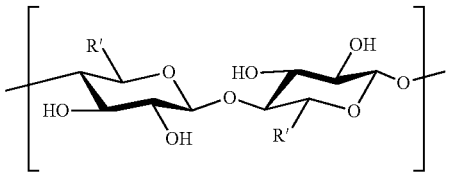

wherein each instance of R' is independently selected from the group consisting of —$CH_2OH$ and C(H)═$NR^2$, with the proviso that at least one R' is —C(H)═$NR^2$, wherein $R^2$ is $C_{10}$-$C_{40}$ alkyl. $R^2$ can be $C_{10}$-$C_{40}$ branched alkyl, $C_{10}$-$C_{40}$ linear alkyl, or $C_{10}$-$C_{40}$ cycloalkyl. In certain embodiments, $R^2$ is —$(CH_2)_nCH_3$, wherein n is 10 to 40, 10 to 30, 10 to 20, 15 to 20, or 17 to 20. In certain embodiments, $R^2$ is —$(CH_2)_{18}CH_3$. In certain embodiments, 1 or 2 instances of R' in the repeating unit of Formula 2 is —C(H)═$NR^2$. The number of instances of R' in the repeating unit of Formula 2 that is —C(H)═$NR^2$ can be controlled by appropriate selection of reagent stoichiometry and reaction conditions and is well within the skill of a person of ordinary skill in the art. In certain embodiments, the hydrophobic cellulose powder is prepared according to any of the methods described herein.

In certain embodiments, the surface finishing solution comprises water, the binder, and the hydrophobic cellulose powder.

Any binder known in the art can be used in connection with the methods described herein. In certain embodiments, the binder is a commercial water based binder commonly used for pad-dry-cure process. Binders can be acrylic-based, butadiene-based, or polyurethane-based. Exemplary binders, include, but are not limited to Dow Primal TM ECO-1291, Dow Rhoplex R-3349, Achitex. Minerva Mineprint Binder ACM, Michelman® 4983-40R, and Achitexminerva Binder WST. Exemplary polyurethane-based binders include, but are not limited to, Tanatex Baygard® FBI and Bondthane™ UD-303. In certain embodiments, the binder is an acrylic-based binder.

Depending on the properties of the binder used in the surface finishing solution, it may be necessary to cure the surface finishing solution treated textile substrate. Curing can be conducted at any temperature between room temperature and 180° C. In certain embodiments, curing is conducted at a temperature of 50 to 160° C.; 100 to 160° C.; or 120 to 160° C.

The textile substrate may be synthetic, semi-synthetic, or natural. Natural organic fibers, including biodegradable materials, cellulosic and/or protein fibers. The textile substrate may be woven or non-woven. The textile substrate may also be in the form of a fabric, a fiber, a filament, a film, garment, chopped or flocculated fiber.

Natural organic textile substrates may be of any plant or animal origin, and include, for example, those fibrous materials derived from natural products containing celluloses, such as any one or a combination of wood, bamboo, cotton, banana, piña, hemp ramie, linen, coconut palm, soya, milk, hoya, bagasse, kanaf, retting, mudrar, silk, wool, cashmere, alpaca, angora wool, mohair, shearling, vicuña, shahtoosh, and the like.

Semi-synthetic textile substrates may include, for example, any one or a combination of viscose, cuprammonium, rayon, polynosic, lyocell, cellulose acetate, and the like.

Synthetic organic textile substrates acrylic, Kevlar, modacrylic, nomex, spandex, nylon, polyester, acrylic, rayon, acetate and the like In certain embodiments, the textile substrate may be cotton, polyester, a blended textile comprising cotton and polyester. In certain embodiments, the textile substrate is a polyethylene terephthalate (PET)/cotton blend.

The hydrophobic cellulose powder can be prepared from virgin cellulose powder or a recycled cellulose powder. The cellulose powder can have a particle size below 100 μm. In certain embodiments, the cellulose powder has a particle size of 1 to 100 μm; 10 to 100 μm; or 50 to 100 μM.

The cellulose powder used in connection with the methods described herein can be prepared according to any method known in the art. In certain embodiments, the cellulose powder is prepared using a hydrolysis method. The hydrolysis method may be acid hydrolysis, alkaline oxidative decomposition, hydrothermal treatment, steam explosion, or the like, or a combination of two kinds of such methods.

The cellulose powder may be prepared, for example, by an organic acid catalyzed hydrothermal treatment of a post-consumer textile comprising a natural, semi-synthetic, and/or synthetic cellulosic material or a natural cellulosic material.

In certain embodiments, the cellulose powder is prepared by subjecting the post-consumer textile to an organic acid catalyzed hydrothermal treatment, the method comprising the step of bringing into contact the post-consumer textile, an aqueous solution, and an organic acid and heating the resulting mixture.

Hydrothermal treatment involves the chemistry of hot water under pressure to carry out chemical reactions. These reactions are usually conducted at temperatures ranging from 100 to 350° C. and pressures in the range from 0.1 to 15 MPa. In certain embodiments, the hydrothermal treatment is conducted at 120-150° C., 125-145° C., 130-140° C., or 132-138° C. In certain embodiments, the hydrothermal treatment is conducted at 0.1 to 0.5, 0.2 to 0.5, 0.2 to 0.4, or 0.25 to 0.35 MPa. The reaction medium may be water alone or in combination with inorganic and/or organic acids.

The organic acid can be methanesulfonic acid, oxalic acid, tartaric acid, citric acid, malic acid, formic acid, acetic acid, or a combination thereof. In certain embodiments, the hydrothermal treatment aqueous solution contains the organic acid catalyst in an amount of 0.1% to 30% or 0.5% to 10% wt/wt. The addition of a larger amount of acid can accelerate the rate of the hydrothermal treatment reaction can shorten the time required for completion and/or assist with decomposition of thicker and/or denser post-consumer textiles.

The post-consumer textile may comprise cotton or polyester and cotton, such as PET and cotton. In instances in which the post-consumer textile contains polyester, it may contain any proportion of polyester content, for example from 1-99% wt/wt.

The post-consumer textile can optionally be divided, e.g., by cutting, tearing, and/or shredding, into smaller pieces prior to the preparation of the cellulose powder. This optional step can improve the yield of cellulose powder and reduce treatment time by increasing the surface area of the treated post-consumer textile.

In certain embodiments, the ratio of solids (i.e., the post-consumer textile) to liquid is 1:30-200 or 1:50-150 by weight. Lower ratios of solid to liquid tend to accelerate the rate of the hydrothermal treatment reaction.

In certain embodiments, hydrothermal treatment comprises heating the mixture at a temperature between 110-180° C. In certain embodiments, hydrothermal treatment comprises heating the mixture at a temperature between 120-150° C. The temperature of the hydrothermal treatment can be increased at a rate of 4-6° C./minute from room temperature to the desired temperature (e.g., 110-180° C. or 120-150° C.).

In certain embodiments, the hydrothermal treatment is conducted at a pressure of 0.1 to 10 MPa or 0.1 to 1 MPa. In certain embodiments, hydrothermal treatment is conducted under autogenic pressure, i.e., pressure generated as a result of heating in a closed system. Alternatively or additionally, the pressure can be applied externally, e.g., by mechanical means.

In certain embodiments, the hydrothermal treatment is conducted in a closed high-pressure reactor, and the temperature is raised to 110-180° C. at a heating rate of 4-6° C./min and then maintained under stirring. During the hydrotheimal treatment, the autogenous pressure in the closed higher-pressure reactor can be in the range of 0.10-1 MPa. The hydrothermal treatment can be completed in 0.5-3 h.

During hydrothermal treatment, subcritical conditions can be achieved in which the cotton fiber can undergo an acid catalyzed hydrolytic degradation reaction thereby producing cellulose powder, while not affecting the polyester fiber.

Pretreatment of Cellulose Powder

The cellulose powder can be obtained after hydrothermal treatment of a textile comprising a cellulosic substrate, such as cotton (e.g., see methods described in PCT Patent Application No. PCT/CN2019/107499, hereby incorporated by reference). After hydrothermal treatment with acid, such as hydrochloric acid, citric acid, maleic acid or methanesulfonic acid, the wet cellulose powder is obtained by filtration without purification. (Step 1) The cellulose powder can be optionally grinded to a smaller particle size. (2) Dry the cellulose powder with air blowing at 40-60° C. (3) Place the dried cellulose powder in oven at 80-170° C. for 0.5-6 h.

The recycled cellulose powder obtained from hydrothermal treatment can first be grinded by a centrifugal mill, followed by sieving to obtain cellulose powder. The dye in the recycled cellulose, if any, can be removed first. Oxidative bleaching can be done using hydrogen peroxide, ozone, sodium hypochlorite, sodium chlorite or other bleaching agents to remove the color from the cellulose powder, and the free dye could be further removed by adsorption on activated carbon.

Surface Modification of Cellulose Powder

In this step, the goal is to replace as many —OH groups on cellulose powder with long carbon chains as possible, which will modify surface property of the cellulose powder from hydrophilic to hydrophobic. Hydrophobic cellulose powder after the surface modification reactions will be purified in order to remove unreacted chemicals, before dispersing in a water formulation. Surface modification is achieved via one of the follow routes.

Esterification of Cellulose Powder

An exemplary esterification reaction of cellulose powder with an alkyloyl halide is shown below:

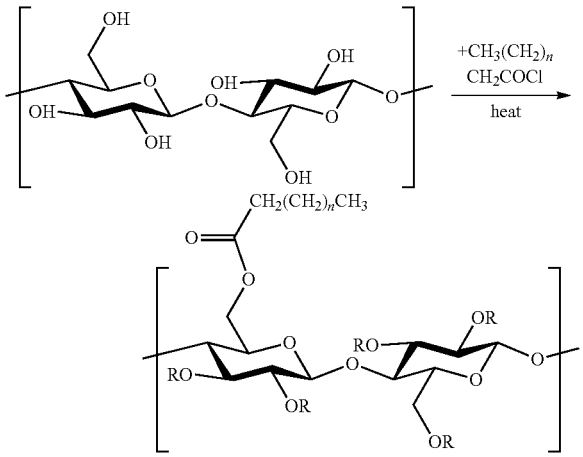

R = $COCH_2(CH_2)_nCH_3$ or Hydrogen

The alkyloyl halide can be an alkyloyl chloride or alkyloyl bromide. The alkyloyl halide can be a linear alkyloyl halide, branched alkyloyl halide, or cyclic alkyloyl halide. The alkyloyl halide can be a $C_{10}$-$C_{40}$ alkyl halide. In certain embodiments, the alkyloyl halide is $CH_3(CH_2)_nCOCl$, wherein n is 10 to 40, 10 to 30, 10 to 20, 15 to 20, or 17 to 20. In certain embodiments, the alkyloyl halide is stearoyl chloride.

The reaction of the cellulose powder and the alkyloyl halide is typically conducted in an organic solvent. In certain embodiments, the organic solvent is a polar aprotic or a polar protic solvent. Exemplary solvents for the reaction of the cellulose powder and the alkyloyl halide include, but are not limited to, alkyl halides, ethers, esters, ketones, amides, amines, formamides, alkanes, aromatics, alkyl nitriles, alcohols, alkyl sulfoxides, and combinations thereof. In certain embodiments, the solvent is pyridine, dichloromethane, 1,2-dichloroethane, chloroform, tetrahydrofuran, diethyl ether, acetone, 1,4-dioxane, acetonitrile, ethyl acetate, propylene carbonate, ethanol, isopropanol, and combinations thereof.

In certain embodiments, the reaction of the alkyloyl halide and the cellulose powder further comprises a base. The base can be an inorganic or organic base. Exemplary inorganic bases include, but are not limited to alkali metal or alkaline earth metal hydroxide, oxide, carbonate, bicarbonate, and combinations thereof. Exemplary organic base include, but are not limited to, trimethylamine, trimethylamine, diisopropylethylamine, tri-n-propylamine, tri-n-butylamine, N-methylpiperidine, or pyridine. The base is not however limited to the above examples. It is feasible to use any organic or inorganic base commonly used for organic synthesis in the esterification reaction.

Typical procedures involve pre-washing of cellulose powder with organic solvents, heating cellulose powder in pyridine, addition of the alkyloyl halide and purification in organic solvents such as ethanol and dichloromethane. Alkyloyl halides with linear alkyl chains having ten or more carbons are preferred to ensure high hydrophobicity. The alkyloyl halide (50-500 mg/mL) can be added with cellulose powder (10-100 mg/mL) under stirring and nitrogen purge at 60° C.-120° C. for 30 min-180 mins.

Laccase/TEMPO Mediated Grafting of Cellulose Powder

The reaction of the laccase/TEMPO mediated grafting of cellulose powder with fatty amine is shown below:

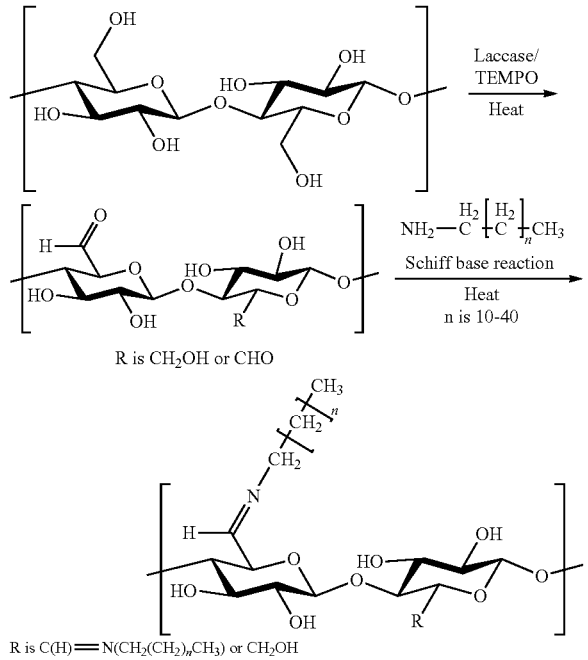

R is $C(H)=N(CH_2(CH_2)_nCH_3)$ or $CH_2OH$

Recycled cellulose powder can first be partially oxidized by laccase/TEMPO thereby forming a partially oxidized cellulose powder comprising a plurality of aldehyde moieties (comprising aldehyde groups at C6 alcohol of one more of the D-glucose of the cellulose polyer)), which can then react with the amino groups of primary alkyl amines, e.g. a primary fatty acid alkyl amines, such as octadecylamine, to form a Schiff base.

The primary alkyl amine can be a linear alkyl amine, branched alkyl amine, or cyclic alkyl amine. The primary alkyl amine can be a primary $C_{10}$-$C_{40}$ alkyl amine. In certain embodiments, the primary alkyl amine is $CH_3(CH_2)_nNH_2$, wherein n is 10 to 40, 10 to 30, 10 to 20, 15 to 20, or 17 to 20. In certain embodiments, the primary alkyl amine is octadecylamine.

Primary alkyl amines with linear alkyl chains having ten or more carbons are preferred to ensure high hydrophobicity. Solutions of laccase and TEMPO are first prepared having a concentration of 0.5 mg/mL-30 mg/mL of TEMPO and 0.5 mg/mL-30 mg/mL of laccase. The mass ratio of the laccase to TEMPO can be in the range of 1:1 to 2:1. After complete dissolution, cellulose (1-50 mg/mL) and primary alkyl amine (10 mg/mL-100 mg/mL) are added and the mixture is allowed to react at 25° C.-60° C. for 6-72 hr.

Application of Water Repellent Surface Finish

The concentration of the cellulose powder in the surface finishing solution can range from 1-10 g/L. The concentration of the binder of the binder in the surface finishing solution can be 50-250 g/L with a solid content of 20-40 wt %. The surface finishing solution is prepared by mixing a mixture comprising the cellulose powder and binder in high speed homogenizer at 5000-20000 RPM for 1-30 mins.

Application of the prepared dispersion onto textile substrates (such as cellulosic fabrics) can be accomplished by either by employing dip coating or by the pad-dry-cure process. Dip coating fabric in the surface finishing solution can be performed for 1-10 minutes. Padding can be conducted by adjusting pressing pressure and roller speed. The roller speed can be between 1-5 m/min and the roller nip pressure can be between 1-5 bar. Heating and curing the water repellant textile substrate can be performed at a temperature of 100-160° C. for 1-10 minutes.

Water-repellent properties of the prepared water repellant textile substrate are characterized according to AATCC 22: Water Repellency Spray Test. Color change is measured by Gray scale test according to AATCC EP1-2012.

Also provided herein is a water repellant textile substrate prepared according to any of the methods described herein.

In certain embodiments, provided herein is a textile substrate comprising a water repellant finish, wherein the water repellant finish comprises a binder and a hydrophobic cellulose powder, wherein the hydrophobic cellulose powder comprises a repeating unit of Formula 1:

1

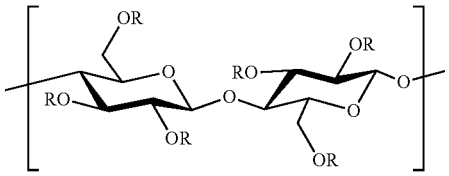

wherein each R is independently selected from the group consisting of hydrogen and $CO_2R^1$; and $R^1$ is $C_{10}$-$C_{40}$ alkyl, with the proviso that at least one R is —$CO_2R^1$; or a repeating unit of Formula 2:

2

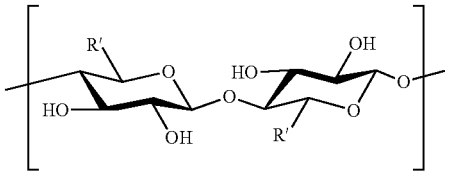

wherein each R' is independently selected from the group consisting of —$CH_7OH$ and —C(H)═$NR^2$; and $R^2$ is $C_{10}$-$C_{40}$ alkyl, with the proviso that at least one R' is —C(H)═$NR^2$; and optionally curing the surface finishing solution treated textile substrate thereby forming a water repellant textile substrate. The water repellant finish can be present as a coating on the surface of the textile substrate.

In certain embodiments, the hydrophobic cellulose powder comprises a repeating unit of Formula 1:

1

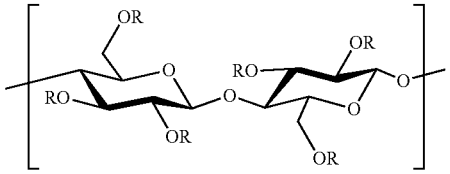

wherein each instance of R is independently selected from the group consisting of hydrogen and —$CO_2R^1$, wherein $R^1$ is $C_{10}$-$C_{40}$ alkyl. $R^1$ can be $C_{10}$-$C_{40}$ branched alkyl, $C_{10}$-$C_{40}$ linear alkyl, or $C_{10}$-$C_{40}$ cycloalkyl. In certain embodiments, $R^1$ is —$(CH_2)_nCH_3$, wherein n is 10 to 40, 10 to 30, 10 to 20, 15 to 20, or 17 to 20. In certain embodiments, $R^1$ is —$(CH_2)_{17}CH_3$. In certain embodiments, the hydrophobic cellulose powder is prepared according to any of the methods described herein.

In certain embodiments, the hydrophobic cellulose powder comprises a repeating unit of Formula 2:

2

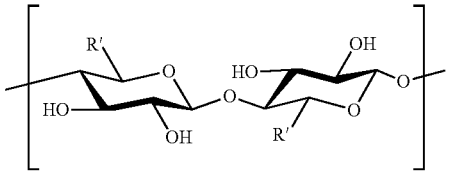

wherein each instance of R' is independently selected from the group consisting of —$CH_2OH$ and —C(H)═$NR^2$, with the proviso that at least one R' is —C(H)═$NR^2$, wherein $R^2$ is $C_{10}$-$C_{40}$ alkyl. $R^2$ can be $C_{10}$-$C_{40}$ branched alkyl, $C_{10}$-$C_{40}$ linear alkyl, or $C_{10}$-$C_{40}$ cycloalkyl. In certain embodiments, $R^2$ is —$(CH_2)_nCH_3$, wherein n is 10 to 40, 10 to 30, 10 to 20, 15 to 20, or 17 to 20. In certain embodiments, $R^2$ is —$(CH_2)_{18}CH_3$. In certain embodiments, the hydrophobic cellulose powder is prepared according to any of the methods described herein.

The binder can be any binder known in the art. In certain embodiments, the binder is a commercial water based binder commonly used for pad-dry-cure process. Binders can be acrylic-based, butadiene-based, or polyurethane-based. Exemplary binders, include, but are not limited to Dow Primal TM ECO-1291, Dow Rhoplex R-3349, Achitex Minerva Mineprint Binder ACM, Michelman® 4983-40R, and Achitexminerva Binder WST. Exemplary polyurethane-based binders include, but are not limited to, Tanatex Baygard® FBI and Bondthane™ UD-303. In certain embodiments, the binder is an acrylic-based binder.

The textile substrate may be synthetic, semi-synthetic, or natural. Natural organic fibers, including biodegradable materials, cellulosic and/or protein fibers. The textile substrate may be woven or non-woven. The textile substrate may also be in the form of a fabric, a fiber, a filament, a film, garment, chopped or flocculated fiber.

In certain embodiments, the textile substrate may be cotton, polyester, a blended textile comprising cotton and polyester. In certain embodiments, the textile substrate is a polyethylene terephthalate (PET)/cotton blend.

EXAMPLES

Example 1

Recycled cellulose powder was obtained from the hydrothermal process. Grinding using a centrifuge mill and sieving was performed to collect cellulose below 100 μm using a sieve shaker. 1-5 g of cellulose powder was washed with 25-50 mL methanol and followed centrifuge for 10-20 mins at 6000 RPM, followed by 25-50 mL of pyridine. Washed cellulose was suspended in 25-50 mL of fresh pyridine. The suspension was transferred to a round bottom flask and is heated to 80-120° C. under nitrogen purge. 5-10 g of stearoyl chloride was added in by a needle syringe. Reaction was continued for 0.5-2 hr. Addition of 200 mL of ethanol was added to quench the reaction. Purification by ethanol was repeated twice by centrifugation. Collected pellets were dissolved into 30-60 mL of dichloromethane and precipitate in 200-400 mL ethanol and repeated twice. Dry the product under room temperature.

Example 2

Recycled cellulose powder was obtained from the hydrothermal process. Sieving was performed to collect cellulose below 100 pin. Laccase solution was prepared in deionized water at 5-10 mg/mL and was stirred for 15-30 minutes. Insoluble was filtered and addition of TEMPO, octadecylamine and cellulose powder. Reaction is allowed to continue for 24-72 hrs at 40° C. Hydrophobic cellulose powder was collected and purified with water and ethanol, each 3 times respectively by centrifugation. Drying was performed at room temperature.

Example 3

A water suspension containing 2.5-5 g/L of hydrophobic cellulose powder was added to water. 100 g/L of Michem® Prime 4983-40R binder (ethylene acrylic acid copolymer) was added. The formulation was dispersed at by a high speed homogenizer for 5 minutes. 100% cotton fabric was dip coated in the thus prepared surface finishing solution. The fabric was cured in an oven at 150° C. for 5 minutes. Water contact angle measurement, water spray test and grayscale color change test were performed.

Example 4

A water suspension containing 5 g/L of hydrophobic cellulose powder was added to water. 100 g/L of BINDER WST (acrylonitrile butadiene copolymer) from Achitex Minerva SpA was added. The formulation was dispersed by a high speed homogenizer for 5 minutes. 100% cotton fabric was dip coated by in the thus prepared surface finishing solution. The fabric was cured in an oven at 150° C. for 5 minutes. Water contact angle measurement, water spray test and grayscale color change test were performed.

Example 5

A water suspension containing 5 g/L of hydrophobic cellulose powder was added to water. 100 g/L of Michem® Prime 4983-40R from Michaelman was added. The formulation was dispersed by a high-speed homogenizer for 5 minutes. 100% cotton fabric was dip coated in the thus prepared surface finishing solution. The fabric was cured in an oven at 150° C. for 5 minutes. Water contact angle measurement, water spray test and grayscale color change test were performed.

| | Spray Test | Water Contact Angle | Gray Scale |
|---|---|---|---|
| Example 3 | 90 | 137.9 | 4.5 |
| Example 4 | 90 | 134.3 | 4.0 |
| Example 5 | 90 | 135.1 | 4.0 |

While the foregoing invention has been described with respect to various embodiments and examples, it is understood that other embodiments are within the scope of the present invention as expressed in the following claims and their equivalents. Moreover, the above specific examples are to be construed as merely illustrative, and not limitative of the reminder of the disclosure in any way whatsoever. Without further elaboration, it is believed that one skilled in the art can, based on the description herein, utilize the present invention to its fullest extent.

What is claimed is:

1. A method of preparing a water repellant textile substrate, the method comprising: contacting a textile substrate with a surface finishing solution comprising a binder and a hydrophobic cellulose powder thereby forming a surface finishing solution treated textile substrate, wherein the binder is present at a concentration of 50-250 g/L in the surface finishing solution and comprises a polymer comprising acrylic, ethylene, butadiene, or a combination thereof, or the binder comprises a polyurethane, wherein a solid content of the binder is 20 to 50 wt %, wherein the hydrophobic cellulose powder is present at a concentration of 1 to 10 g/L in the surface finishing solution and has an average particle size between 10-100 μm, wherein the hydrophobic cellulose powder comprises a repeating unit of Formula 1:

1

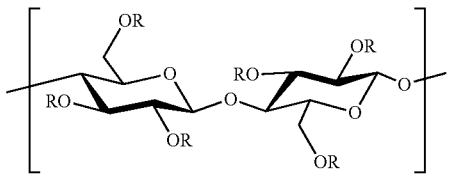

wherein each R is independently selected from the group consisting of hydrogen and —$COR^1$; and $R^1$ is $C_{10}$-$C_{40}$ alkyl, with the proviso that at least one R is —$COR^1$; or a repeating unit of Formula 2:

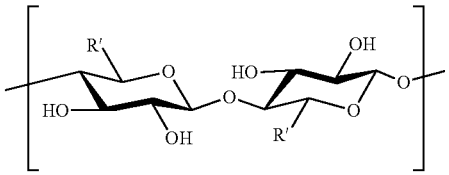

wherein each R' is independently selected from the group consisting of —$CH_2OH$ and —C(H)=$NR^2$; and $R^2$ is $C_{10}$-$C_{40}$ alkyl, with the proviso that at least one R' is —C(H)=$NR^2$; and optionally curing the surface finishing solution treated textile substrate thereby forming the water repellant textile substrate.

2. The method of claim 1, wherein the textile substrate is cotton, polyester, or a combination thereof.

3. The method of claim 1, wherein the surface finishing solution comprises water, the binder, and the hydrophobic cellulose powder.

4. The method of claim 1, further comprising: contacting a cellulose powder and an alkyloyl halide thereby forming the hydrophobic cellulose powder comprising the repeating unit of Formula 1; or contacting a cellulose powder with an oxidizing agent in an aqueous dispersion thereby forming a partially oxidized cellulose powder comprising a plurality of aldehyde moieties and contacting the partially oxidized cellulose powder with a primary alkyl amine in an aqueous dispersion thereby forming the hydrophobic cellulose powder comprising the repeating unit of Formula 2.

5. The method of claim 4, wherein the oxidizing agent comprises laccase and (2,2,6,6-tetramethylpiperidin-1-yl) oxyl (TEMPO).

6. The method of claim 5, wherein in the step of contacting the cellulose powder with laccase and TEMPO, the cellulose powder is present at a concentration of 1 to 50 mg/mL in the aqueous dispersion; and the laccase and TEMPO are each independently present at a concentration of 0.5 mg/mL to 30 mg/mL in the aqueous dispersion.

7. The method of claim 4, wherein the primary alkyl amine is of $NH(CH_2)_nCH_3$, wherein n is whole number selected from 10 to 30; and in the step of contacting the partially oxidized cellulose powder with a primary alkyl amine, the primary alkyl amine is present at a concentration of 10 to 100 mg/mL in the aqueous dispersion.

8. The method of claim 6, wherein the step of contacting the cellulose powder with the laccase and TEMPO is conducted at 25 to 60° C.

9. The method of claim 1, wherein the surface finishing solution treated textile substrate is cured at a temperature of 120 to 160° C.

10. The method of claim 4, wherein the method comprises: contacting cellulose powder with laccase and TEMPO in an aqueous dispersion at 25 to 60° C., wherein the cellulose powder is present at a concentration of 1 to 50 mg/mL in the aqueous dispersion; and the laccase and TEMPO are each independently present at a concentration of 0.5 mg/mL to 30 mg/mL in the aqueous dispersion; thereby forming a partially oxidized cellulose powder comprising a plurality of aldehyde moieties; contacting the partially oxidized cellulose powder with a primary alkyl amine having the formula $CH_3(CH_2)_nNH_2$, wherein n is a whole number selected from 10 to 30, in an aqueous dispersion at temperature of 60 to 120° C., wherein the primary alkyl amine is present at a concentration of 10 to 100 mg/mL in the aqueous dispersion; thereby forming a hydrophobic cellulose powder comprising the repeating unit of Formula 2; contacting a textile substrate with a surface finishing solution comprising the hydrophobic cellulose powder and a binder, wherein the binder comprises a polymer comprising acrylic, ethylene, butadiene, or a combination thereof; or the binder comprises a polyurethane; the binder is present at a concentration of 50-250 g/L in the surface finishing solution; and the solid content of the binder is 20 to 50 wt % thereby forming a surface finishing solution treated textile substrate; and curing the surface finishing solution treated textile substrate at a temperature of 120 to 160° C. thereby forming the water repellant textile substrate.

11. The water repellant textile substrate prepared according to the method of claim 1.

12. The surface finished water repellant textile substrate prepared according to the method of claim 10.

* * * * *